US006145783A

United States Patent [19]

Kim

[11] Patent Number: 6,145,783

[45] Date of Patent: Nov. 14, 2000

[54] DEVICE FOR ADJUSTING THE POSITION OF FILM ROLLS IN LAMINATORS

[75] Inventor: Yang-Pioung Kim, Seoul, Rep. of Korea

[73] Assignee: GMP Co., Ltd., Seoul, Rep. of Korea

[21] Appl. No.: 09/285,824

[22] Filed: Apr. 2, 1999

[51] Int. Cl.[7] ..... B65H 16/06

[52] U.S. Cl. ..... 242/598; 242/423.1; 242/538.2; 242/592; 242/599.3

[58] Field of Search ..... 242/538, 538.1, 242/538.2, 598, 598.1, 598.3, 598.4, 599, 599.3, 599.4, 592, 423.1

[56] References Cited

U.S. PATENT DOCUMENTS

| | | | |
|---|---|---|---|
| 2,152,118 | 3/1939 | Walter et al. | 242/538 X |
| 2,609,005 | 9/1952 | Booth | 242/598.4 X |
| 3,941,320 | 3/1976 | Strunk | 242/423.1 X |
| 4,363,455 | 12/1982 | Del Bianco et al. | 242/599.3 X |
| 4,378,095 | 3/1983 | Reynolds | 242/599.3 X |
| 4,487,382 | 12/1984 | Weaver | 242/538.1 X |
| 6,056,234 | 5/2000 | Kim | 242/598 |

*Primary Examiner*—Donald P. Walsh
*Assistant Examiner*—William A. Rivera
*Attorney, Agent, or Firm*—Harrison & Egbert

[57] ABSTRACT

A device for adjusting a position of two film rolls so as to align the two film rolls with each other in laminators is disclosed. A shaft holder engages with one end of a housing and movably receives one end of a roll shaft. A connection bolt, having a head and an externally-threaded shank provided with a woodruff key, engages with the other end of the housing from the inside to the outside of the housing, with the head being positioned inside the housing and the shank partially projecting from the housing. A bearing is set in the head of the connection bolt and holds the roll shaft passing though the shaft holder. An annular setting lever engages with the shank of the connection bolt at a position outside the housing. An adjusting handle is fitted over the woodruff key of the connection bolt. The above handle has a radial screw hole, with a wrench bolt being movably screwed into the screw hole so as to removably fix the handle to the woodruff key of the connection bolt.

1 Claim, 3 Drawing Sheets

DEVICE FOR ADJUSTING THE POSITION OF FILM ROLLS IN LAMINATORS

BACKGROUND OF THE INVENTION

1. Field of the Invention

The present invention relates, in general, to a device for adjusting the positions of two protective film rolls on roll shafts so as to align the two film rolls with each other in laminators and, more particularly, to an improvement in such a device to easily and quickly adjust the position of the two film rolls by moving a roll shaft in either direction using a position adjusting handle provided at one end of the roll shaft.

2. Description of the Prior Art

As well known to those skilled in the art, laminators are used for covering both sides of an object sheet with two sheets of protective film. That is, in the operation of such laminators, the protective film is supplied from upper and lower film rolls, thus passing through the nip of two heating rollers and the nip of two pressure rollers. In such a case, an object sheet moves along a sheet passage so as to pass through the two nips of the above rollers, so that the object sheet is covered with the protective film at both sides thereof, thus becoming a laminated sheet.

During such an operation of the laminators, it is necessary to prevent the protective film from crumpling when the film is coated on both sides of each object sheet. In order to eliminate such a crumpling in the film and accomplish a desired flatness of the film, the positions of the two film rolls on the roll shafts have to be precisely controlled so as to be precisely aligned with each other.

In the prior art, the position of the two film rolls on the roll shafts is adjusted using set bolts provided on the cover caps of the film rolls. A typical device for adjusting the position of film rolls in laminators is shown in FIG. 1. As shown in the drawing, when it is necessary to adjust the position of the film rolls 101 on the roll shafts 100, a set bolt 102, which is provided on each end of each of the two film rolls 101, is loosened prior to moving the roll 101 on the shaft 100 in either direction with the roll 101 being set on the shaft 100. After adjusting the position of the roll 101 on the shaft 100, the set bolt 102 is tightened, thus fixing the adjusted position of the film roll 101. However, the adjustment of the position of the film rolls using such set bolts is problematic in that the adjustment is time-consuming since it is necessary to loosen and tighten the set bolts one by one. This reduces work efficiency while adjusting the position of the film rolls.

SUMMARY OF THE INVENTION

Accordingly, the present invention has been made keeping in mind the above problems occurring in the prior art, and an object of the present invention is to provide a device for adjusting the position of two protective film rolls in laminators, which receives one end of a roll shaft and has an adjusting handle at a position opposite to the roll shaft, and which moves the roll shaft along with a film roll in either direction when the adjusting handle is rotated in either direction, thus easily and quickly adjusting the position of the two film rolls so as to align the two film rolls with each other.

In order to accomplish the above object, the present invention provides a device for adjusting a position of two film rolls so as to align the two film rolls with each other in laminators, the device comprising: two roll shafts respectively used for holding the two film rolls at upper and lower portions of a laminator; a housing positioned at one end of each of the two roll shafts, the housing having first and second internally-threaded holes at both ends thereof; a shaft holder having a central hole and an externally-threaded part, the holder engaging with the first internally-threaded hole of the housing and movably receiving one end of each of the two roll shafts at the central hole; a connection bolt having a head and an externally-threaded shank provided with a woodruff key at an outside end thereof, the connection bolt engaging with the second internally-threaded hole of the housing, with the head being positioned inside the housing and the shank partially projecting from the second internally-threaded hole of the housing; a bearing set in the head of the connection bolt and holding the end of the roll shaft passing though the shaft holder; an annular setting lever having an internally-threaded hole and engaging with the shank of the connection bolt at a position outside the second internally-threaded hole of the housing; a bracket provided on the laminator and having a groove, thus seating the shank of the connection bolt in the groove at a position outside the setting lever with the woodruff key of the shank projecting from the groove; and an adjusting handle fitted over the woodruff key of the connection bolt at a position outside the bracket, the handle having a radial screw hole with a wrench bolt being movably screwed into the screw hole so as to removably fix the handle to the woodruff key of the connection bolt.

BRIEF DESCRIPTION OF THE DRAWINGS

The above and other objects, features and other advantages of the present invention will be more clearly understood from the following detailed description taken in conjunction with the accompanying drawings, in which:

FIGS. 4*a* and 4*b* are sectional views, showing the operation of the adjusting device of this invention, in which:

FIG. 4*a* shows the device when the device fully moves a roll shaft to the right; and FIG. 4*b* shows the device when the device fully moves the roll shaft to the left.

DESCRIPTION OF THE PREFERRED EMBODIMENTS

Figure 1:
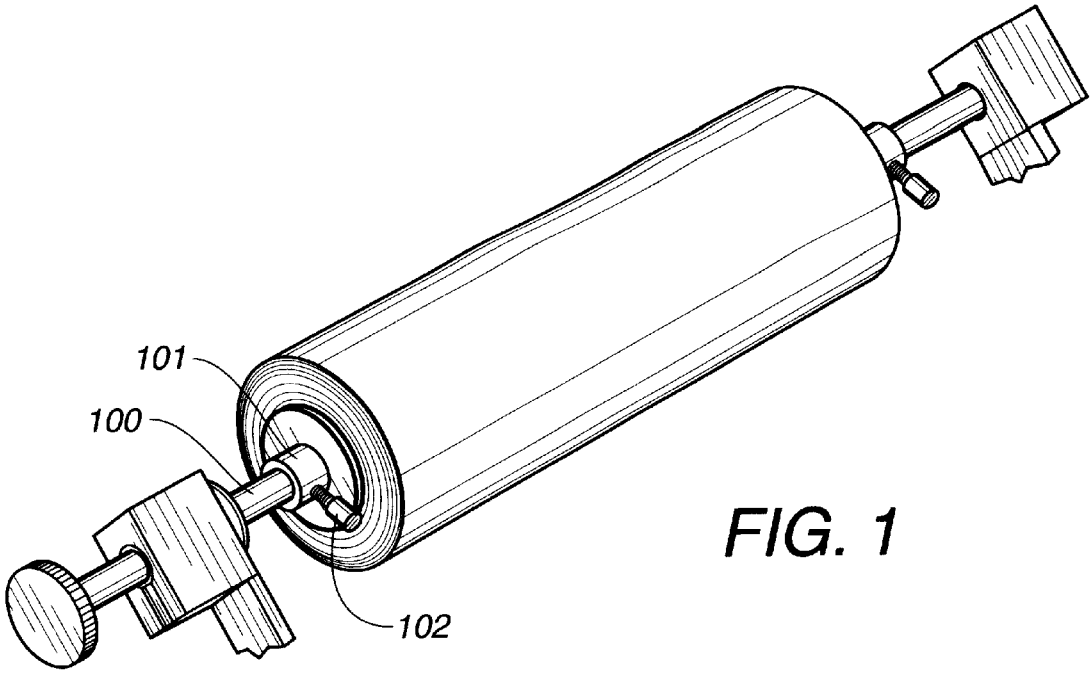
FIG. 1 is a perspective view of a typical device for adjusting the position of a film roll in laminators, with two set bolts being provided at cover caps of the film roll for adjusting the position of the film roll.
Figure 2:
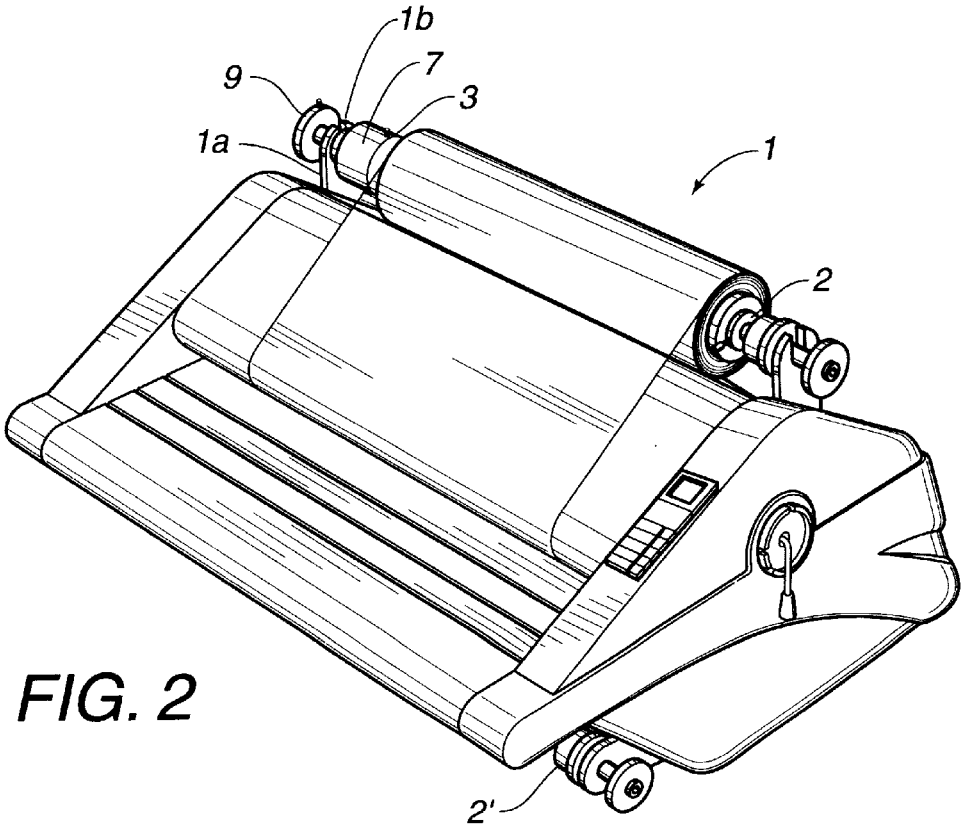
FIG. 2 is a perspective view, showing an adjusting device of this invention set on a laminator.
Figure 3:
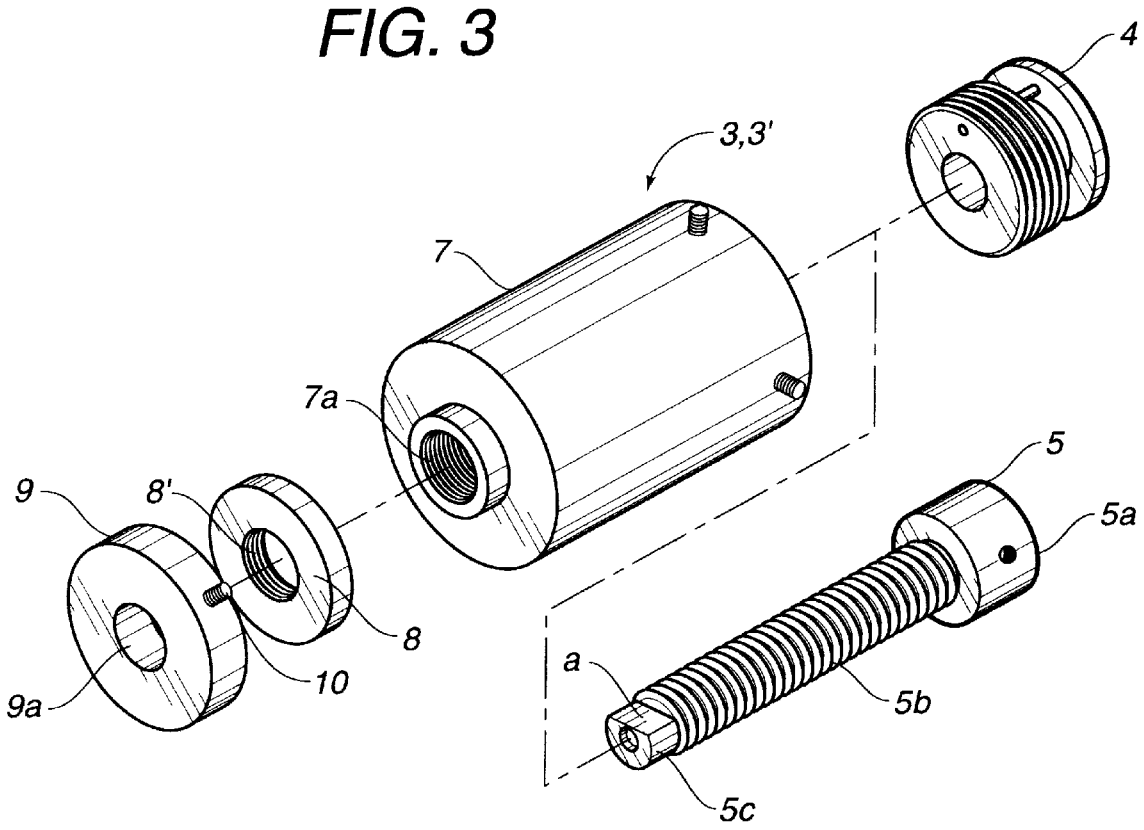
FIG. 3 is an exploded perspective view of the adjusting device in accordance with the preferred embodiment of this invention.

For ease of description, the end of the device on the left-hand side of the drawings will be referred to as the left end of the device and the opposite end on the right-hand side of the drawings will be referred to as the right end.

As shown in the drawings, two roll shafts 2 and 2', individually holding a film roll, are arranged on the upper and lower portions of a laminator 1, respectively. One adjusting device 3, 3' of this invention is coupled to the left end of each of the two roll shafts 2 and 2'. The above adjusting device 3, 3' has a roll shaft holder 4 at the right end thereof. The above holder 4, having an externally-threaded part and a central hole, is screwed into the internally-threaded right end of a cylindrical housing 7 at the threaded part. A connection bolt 5, with a bearing 6 set a bolt head 5*a*, engages with the left end of the housing 7 through a screw-type engagement, with the bolt head 5*a* being positioned inside the housing 7 and an externally-threaded shank 5*b* of the bolt 5 partially projecting from the left end of the housing 7. In such a case, the above housing 7 has an internally-threaded hole 7*a* at the left end, so that the bolt 5 is screwed into the internally-threaded hole 7*a* of the housing 7 from the inside to the outside of the housing 7. Of course, it is necessary to bring the bolt 5 into engagement with the housing 7 prior to engagement of the shaft holder 4 with the housing 7. The left end of the above bolt 5 is formed as a woodruff key 5*c*. When assembling a roll shaft 2, 2' with a device 3, 3', the left end of the shaft 2, 2' passes through the shaft holder 4 until it is fully seated in the bearing 6 of the bolt head 5*a* inside the housing 7. An annular setting lever 8, internally threaded at its internal surface 8', engages with the shank 5*b* at a position outside the housing 7. The shank 5*b* of the bolt 5 is, thereafter, seated in a groove 1*b* of the left-hand bracket la of the laminator 1. In such a case, the woodruff key 5*c* of the shank 5*b* projects from the groove 1*b*. The adjusting handle 9, having a central hole 9*a*, is fitted over the woodruff key 5*c* at the hole 9*a*. A screw hole 9*b* is radially formed on the above handle 9, while a wrench bolt 10 is movably screwed into the screw hole 9*b* so as to allow the inside end of the bolt 10 to be brought into pressure contact with the flat surface "a" of the woodruff key 5*c* when the wrench bolt 10 is fully tightened. That is, it is possible to removably fix the adjusting handle 10 at a position on the woodruff key 5*c* using the wrench bolt 9.

In the drawings, the reference numeral 11 denotes a film roll held on the roll shaft 2, the numeral 12 denotes a set bolt provided at each cover cap of the film roll 11, the numeral 13 denotes a circular cap which movably holds the right end of the roll shaft 2, and the numeral 13' denotes a hexagonal hole which is formed on the circular cap 13 so as to movably receive the right end of the roll shaft 2.

The operational effect of the above device will be described hereinbelow.

Two film rolls 11 and 11' are set on the two roll shafts 2 and 2', respectively, prior to tightening the set bolts 12 so as to fix the film rolls 11 and 11' to the roll shafts 2 and 2'. After setting the film rolls 11 and 11' on the roll shafts 2 and 2', the right end of each roll shaft 2, 2' is movably received into the hexagonal hole 13' of the circular cap 13. In such a case, the circular cap 13 is positioned at the right-hand side of the laminator 1.

On the other hand, the left end of each roll shaft 2, 2' is fitted into the adjusting device 3, 3' which is positioned at the left-hand side of the laminator 1. The two films rolls 11 and 11' are thus installed on the upper and lower portions of the laminator 1. When the two film rolls 11 and 11', installed on the laminator 1, are not aligned with each other, it is necessary to adjust the position of either film roll 11, 11' in order to precisely align the two film rolls 11 and 11' with each other.

Figure 4A:
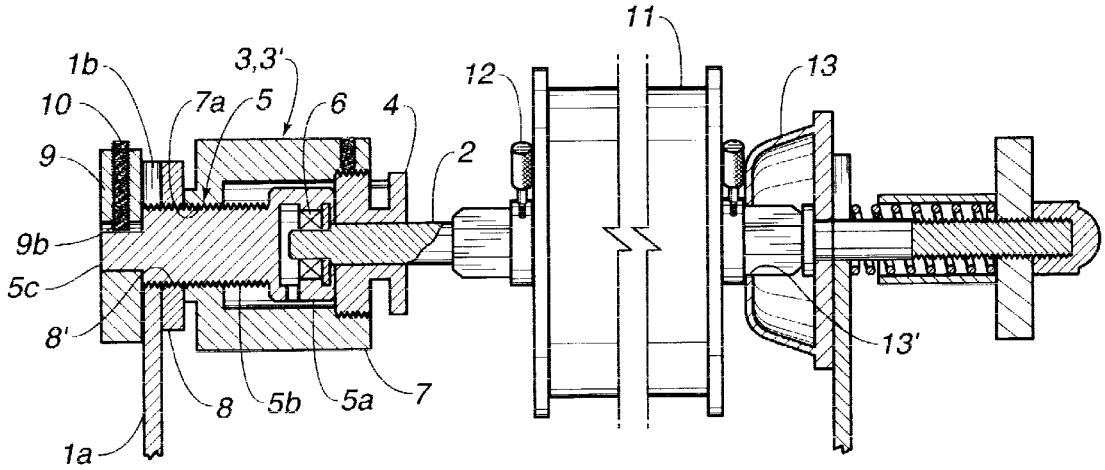
Figure 4B:
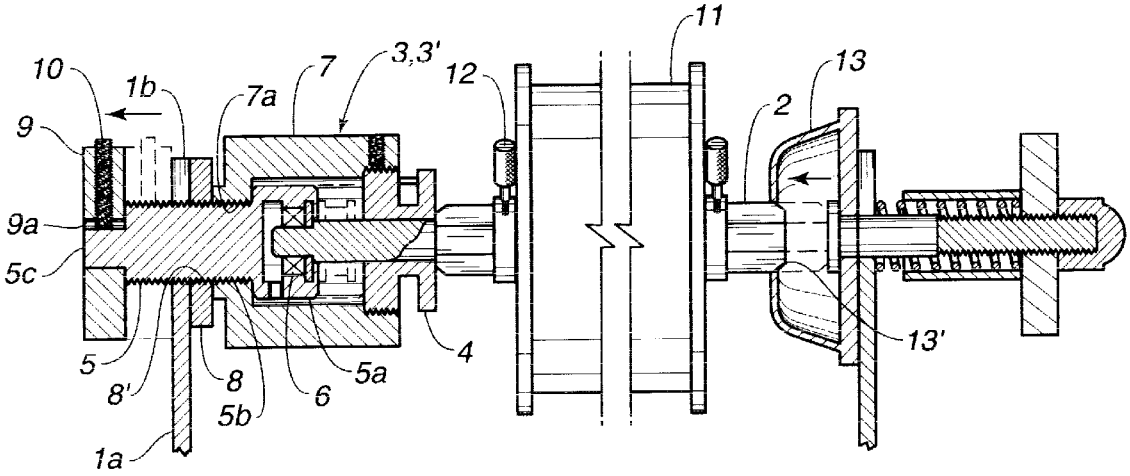

For example, the position of the upper film roll 11 may be adjusted by operating the adjusting device 3 associated with the upper film roll 11 with the lower film roll 11' being fixed at its set position. In such a case, the roll shaft 2, associated with the upper film roll 11, is moved to the right or left as shown in FIGS. 4*a* and 4*b*. FIG. 4*a* shows the device 3 when the device 3 fully moves the roll shaft 2 to the right. When it is necessary to move the roll shaft 2 to the right, the adjusting handle 9 is rotated clockwise. The connection bolt 5 is thus moved to the right since the housing 7, of which the internally-threaded hole 7*a* engages with the externally-threaded shank 5*b* of the bolt 5, is fixed. The roll shaft 2, coupled to the head 5*a* of the connection bolt 5, is thus moved to the right. The adjusting handle 9 is continuously operated until the position of the upper film roll 11 is precisely aligned with the position of the lower film roll 11'.

When it is necessary to move the roll shaft 2 of the upper film roll 11 to the left so as to align the two film rolls 11 and 11' with each other, the adjusting handle 9 is rotated counterclockwise, thus moving the roll shaft 2 to the left until the position of the upper film roll 11 is precisely aligned with the position of the lower film roll 11' as shown in FIG. 4*b*. In such a case, the adjusted position of the upper film roll 11 is fixed by the setting lever 8 which fixes the adjusted position of the connection bolt 5.

As described above, the present invention provides a device for adjusting the position of two protective film rolls in laminators. The above device receives one end of a roll shaft and has an adjusting handle at a position opposite to the roll shaft. The device moves the roll shaft along with a film roll in either direction when the adjusting handle is rotated in either direction, thus easily and quickly adjusting the position of the two film rolls so as to align the two film rolls with each other.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. The device for adjusting a position of two film rolls so as to align the two film rolls with each other in laminators, comprising:

two roll shafts respectively used for holding the two film rolls at upper and lower portions of a laminator;

a housing positioned at one end of each of the two roll shafts, said housing having first and second internally-threaded holes at both ends thereof;

a shaft holder having a central hole and an externally-threaded part, said holder engaging with the first internally-threaded hole of the housing and movably receiving one end of the roll shaft at the central hole;

a connection bolt having a head and an externally-threaded shank provided with a woodruff key at an outside end thereof, said connection bolt engaging with the second internally-threaded hole of the housing, with the head being positioned inside the housing and the shank partially projecting from the second internally-threaded hole of the housing;

a bearing set in said head of the connection bolt and holding the end of the roll shaft passing though the shaft holder;

an annular setting lever having an internally-threaded hole and engaging with the shank of the connection bolt at a position outside the second internally-threaded hole of the housing;

a bracket provided on the laminator and having a groove, thus seating the shank of the connection bolt in the groove at a position outside the setting lever with the woodruff key of the shank projecting from said groove; and an adjusting handle fitted over the woodruff key of the connection bolt at a position outside the bracket, said handle having a radial screw hole with a wrench bolt being movably screwed into the screw hole so as to removably fix the handle to the woodruff key of the connection bolt.

* * * * *